US006311394B1

(12) United States Patent
White

(10) Patent No.: US 6,311,394 B1
(45) Date of Patent: Nov. 6, 2001

(54) COMBINATION 37-WIRE UNILAY STRANDED CONDUCTOR AND METHOD AND APPARATUS FOR FORMING THE SAME

(75) Inventor: Paul White, Newmarket (CA)

(73) Assignee: Nextrom, Ltd., Concord (CA)

( * ) Notice: Subject to any disclaimer, the term of this patent is extended or adjusted under 35 U.S.C. 154(b) by 0 days.

(21) Appl. No.: 09/370,765

(22) Filed: Aug. 9, 1999

(51) Int. Cl.[7] ..... H01R 43/00
(52) U.S. Cl. ..... 29/872; 29/33 F; 29/868
(58) Field of Search ..... 29/872, 33 F, 868

(56) References Cited

U.S. PATENT DOCUMENTS 3,823,542 * 7/1974 Pemberton .
4,332,131 * 6/1982 Palsky et al. .
4,471,161 * 9/1984 Drummond .
5,260,516 * 11/1993 Blackmore .
5,418,333 * 5/1995 Sanderrs .
5,449,861 * 9/1995 Fujino et al. .
5,496,969 * 3/1996 Blackmore .
5,640,766 * 6/1997 Fujino et al. .

* cited by examiner

*Primary Examiner*—Carl J. Arbes
(74) *Attorney, Agent, or Firm*—Lackenbach Siegel Marzullo Aronson & Greenspan, P.C.

(57) ABSTRACT

A combination 37-wire unilay stranded conductor includes a 19-wire stable unilay construction includes two layers of wires on a core wire, each having a diameter D, to define a hexagon that circumscribes the 19 nineteen wires. A corner wire is positioned at each corner of the hexagon, the corner wires being formed to provide bearing surfaces facing radially outwardly and defining a circle having a diameter of approximately 4.7 D. A third layer of wires includes a smaller diameter wire having a diameter of approximately 0.8 D contacting each bearing surface, and pairs of two wires each having diameters D are positioned between the smaller wires and are nested in a recess formed by two wires in a preceding underlying layer to define a substantially circular outer cable configuration. The wires in the conductor are in contact with at least one wire in a previous inner layer and with circumferentially adjacent wires in the same layer thereby providing a stable conductor having a circular outer configuration without undesired gaps between adjacent wires in the third layer. A method and apparatus for making the 37-wire conductor are described.

3 Claims, 4 Drawing Sheets

COMBINATION 37-WIRE UNILAY STRANDED CONDUCTOR AND METHOD AND APPARATUS FOR FORMING THE SAME

BACKGROUND OF THE INVENTION

1. Field of the Invention

This invention generally relates to stranded cable manufacturing and, more particularly, to combination 37-wire unilay stranded conductors and a method and apparatus for forming the same.

2. Description of the Prior Art

Compressed stranded cable conductors are well known in the art. Examples are disclosed in U.S. Pat. Nos. 4,473,995; 3,383,704; and 3,444,684. Such cables have normally been preferred over uncompressed cables or compacted cables for several reasons. Compressed conductors typically have a nominal fill factor from about 81% to about 84%. Fill factor is designed as the ratio of the total cross-section of the wires in relation to the area of the circle that envelopes the strand.

Uncompressed cables require the maximum amount of insulation because the cable diameter is not reduced and because interstitial valleys or grooves between the outer strands are filled with insulation material. Typical fill factors for these conductors are about 76%. On the other hand, compact conductors, although eliminating the above-mentioned drawbacks, might have physical properties that are not desirable for specific applications. Typical fill factors for these constructions range from 91% to 97%.

Multi-wire compressed conductor strands are made in different configurations and by many different methods. Each method and configuration has advantages and disadvantages. One approach is to form the strand with a central wire surrounded by one or more helically layered wires. The strand is made by twisting the wires of each layer about the central wire with a wire twisting machine. A reverse concentric strand is one example of a strand made by this method. Each layer of a reverse concentric strand has a reverse lay in successive layers and an increased length of lay with respect to the preceding layer. In the case of a 19-wire conductor strand, two passes might be required through a wire twisting machine to make the strand.

One example of a known strand involves one pass for a 6-wire layer having, for example, a right hand lay over a central wire and a second pass for a 12-wire layer having a left hand lay over the first 6-wire layer. The strand can also be made in one pass with machines having cages rotating in opposite directions applying both layers at the same time, but the productivity of such machines is very low.

A unilay conductor is a second example of a conductor strand having helically laid layers disposed about the central wire. Each layer of a unilay strand has the same direction of lay and the same length of lay. Because each layer has the same lay length and the same direction, the strand may be made in a single pass. As a result, productivity increases.

Unilay strands are used in a variety of configurations and commonly for sizes up to and including 500 Kcm.

These strands can be typically manufactured on a Single Twist, Tubular, Rigid, Planetary Machine and, more recently, on the Double Twist machine. The economic benefits of the Double Twist machine outweigh the other production processes and the Double Twist machine is the preferred system for this product. Historically, the limitations of the process has hindered the widespread use for some products. This occurs primarily because of the two stage closing process and the accessibility of the finished product for forming and shaping.

Referring to FIG. 1, one of the most commonly used unilay conductors is a conductor $S_1$ formed with 19 wires of the same diameter D. In such a strand, the six wires 4 of the inner layer $L_1$ and the twelve wires 6 of the outer layer $L_2$ are twisted about the central core wire 2 in the same way and in a concentric pattern. Normally, a hexagonal pattern (dash outline H) is formed, and not the desired round configuration C. This hexagonal configuration presents many basic problems because the circumscribing circle C creates six voids V. These voids are filled with insulation requiring adinsulation for a minimum insulation thickness as compared with a true concentric strand.

Experience has also shown that the wires at the corners tend to change position and to back up during extrusion.

As a result of this concern, engineers in the conductor wire industry have been seeking to develop conductor strands that maintain a circular cross section and increase the uniformity of the conductor section.

One approach is to try to position the outer twelve conductors in such a way as to have each two wires 6*a*, 6*b* at the second layer $L_2$ perched on the surface of one of the six wires 4 of the first layer $L_1$. Such conductor $S_2$, shown in FIG. 2, is sometimes referred to as having a "smooth body" construction that avoids the problem mentioned above in connection with the conductor $S_1$ in FIG. 1.

However, the "smooth body" construction is not stable and cannot be easily achieved on a commercial basis without considerably reducing the lays and, therefore, the productivity of the machine. Furthermore, any variation in wire diameter or tension in the wires can cause the conductor strand to change into the hexagonal configuration, shown in FIG. 1, which represents a stable, low energy construction.

Another attempt to solve the problem has been to make a composite strand $S_3$ in accordance with U.S. Pat. No. 4,471,161 and shown in FIG. 3. This last construction has the advantage of being stable, but the disadvantage of requiring wires 6*c*, 6*d* with different diameters $D_1$, $D_2$, in the second layer $L_2$. However, in order to maintain a circular cross section, the diameters $D_1$, $D_2$ that must be selected result in gaps or grooves G between the wires into which insulation can penetrate. A variation of this idea is depicted in FIG. 4 where the 7-wire cover (1+6) is compressed, such compression allowing the small diameter wires 6*d* to move radially inwardly to a degree that substantially eliminates the tangential gaps in the 12-wire layer $L_2$.

Another solution has been to use a combination of formed or shaped and round elements or wires to assure that the desired fill factor is realized with a stable strand designed to minimize the outer gap area and optimize the use of the insulating material. One example of such a strand uses a combination of seven "T" shaped elements with 11 round elements "O" providing a stable strand design. Such constructions are shown in publication No. 211091 published by Ceeco Machinery Manufacturing Limited, at page 537–7. In this construction, the outer 11 elements or wires "O" are in contact with each other thereby minimizing the grooves or spaces and the fill factor is approximately 84%. In such an "O/T/O" configuration, the outside wires abut against the flat surfaces of the outer "T" layer and have no tendency to collapse into the minimal spaces or grooves therein. A modification of the aforementioned strand involves various degrees of compression of the outer round wires with the result that the range of fill factors can be increased from approximately 84% to 91%. Because the inner layer of the seven conductors is also compacted in the inner layer, elements produce a substantially cylindrical outer surface with interstitial grooves minimized or substantially eliminated. While this eliminates the aforementioned problem of the outer layer collapsing into the grooves of the inner layer, such cables have fill factors that are too high for some applications.

A modified concentric compressed unilay stranded conductor design is disclosed in U.S. Pat. No. 5,496,969 issued to Nextrom, Ltd., the assignee of the subject application. The conductor, according to the aforementioned patent, is formed of combinations of compressed wires that nominally have equal diameters. The number of wires selected in any two adjacent layers is not divisible by a common integer with the exception of the integer "1". To achieve such construction, the conductor in one or more of the layers may need to be formed into sectored cross sectional configurations. However, to so form the wires they need to be compressed inwardly. The resulting increase in fill factor and decrease in conductor outer diameter, however, has not been acceptable for certain applications in some segments of the market.

A concentric compressed unilay stranded conductor construction is also disclosed in U.S. Pat. No. 5,260,516, which discloses conductors having 1+7+12+17 wires. However, such construction requires substantial forming of each of the individual wires in the first and second layers of the conductors, with the exception of the central core wire. This typically requires additional forming roller assemblies each specifically designed for a given set of desired profiles. This can increase the cost of manufacture and slow up production.

SUMMARY OF THE INVENTION

It is an object of the present invention to provide a combination 37-wire unilay stranded conductor that can be manufactured to eliminate the problems mentioned in the prior art while maintaining a high manufacturing efficiency.

It is another object of the present invention to provide a 37-wire stranded round conductor that has desirable physical characteristics for a wide range of applications and compares favorably with the traditional reverse lay concentric compressed strand conductors.

It is still another object of the present invention to provide a 37-wire stranded round conductor that maintains a circular cross section and prevents the undesired movements of wire strands from one layer into interstices or spaces of adjoining layers, which distorts the desired exterior circular cross sectional configuration of the resulting conductor.

It is yet another object of the present invention to provide a 37-wire stranded round conductor that can be minimally shaped while maintaining the integrity of the construction without limitation for further processing.

It is an additional object of the present invention to provide a 37-wire stranded conductor that will provide consistent and reliable cross sectional configurations while using strands or wires of different diameters only in the outer or third layer.

It is a further object of the present invention to provide a 37-wire stranded conductor as in the previous objects in which the manufacturing process is facilitated by avoiding the use of forming roller assemblies to individually shape or form multiple wires in the conductor.

It is still a further object of the present invention to provide a 37-wire stranded conductor that provides desirable properties while only minimally forming nineteen wires simultaneously in a hex-die mounted for free rotation to accommodate shifts in the conductor about its axis.

It is yet a further object of the present invention to provide a 37-wire stranded conductor that reliably overcomes the problem of deterioration of some conductors which assume the "hexagonal" cross sectional shape when the same diameter wires are stranded with the same lay length and with the same lay direction.

It is an additional object of the present invention to provide a 37-wire stranded conductor that will effectively provide a wide lay tolerance for a wide range of conductor diameters.

It is still an additional object to provide a 37-wire stranded conductor that provides a circular cross section by minimally forming six wires while minimizing work hardening and substantially maintaining the flexibility of the conductor.

In order to achieve the above objects, as well as others that will become apparent hereinafter, a combination 37-wire unilay stranded conductor in accordance with the present invention comprises a 19-wire stable unilay construction, including two layers of wires on a core wire, each having a diameter D, to define a hexagon that circumscribes said 19 wires. A corner wire is positioned at each corner of said hexagon, said corner wires being formed to provide bearing surfaces facing radially outwardly and defining a circle having a diameter of approximately 4.7 D. A third layer of wires includes a smaller diameter wire having a diameter of approximately 0.8 D contacting each bearing surface and pairs of two wires, each having diameters D, positioned between said smaller wires and being nested in a recess formed by two wires in a preceding underlying layer to define a substantially outer circular conductor configuration test substantially maintains flexibility of the conductor.

A method in accordance with the present invention of producing a 37-wire unilay stranded conductor comprises the steps of advancing a substantially circular core wire having a diameter D and a central axis along a predetermined direction. A first layer of six wires, each having a diameter D, is wound on said core wire with a predetermined lay. A second layer of twelve wires, each having a diameter D, is wound on said first layer with a lay substantially equal to said predetermined lay to provide a stable 19-wire "hex" unilay conductor construction, that generally defines, in cross section, a hexagon that circumscribes said wires in said second layer, wherein the wires positioned at said corners of said hexagon initially define a maximum diametric dimension of 5 D and face wires positioned between said corner wires, in said second layer, define a concentric circle having a diameter of approximately 4.46 D. The "hex" conductor is subsequently fed through a hexagonal ("hex") die configured and dimensioned to form or shape said corner wires to reduce that maximum diametric dimension of a concentric circle defined by said corner wires to approximately 4.7 D and forming radially outwardly facing bearing surfaces. A third layer of wires is wound on the second layer in unilay constructions with six wires, each having a diameter 0.8 D arranged to contact said bearing surface, and winding twelve wires, each having a diameter D, on said second layer, to contact two wires in said second layer and one of said 0.8 D wires in said third layer to provide a circular outer configuration without undesired gaps between adjacent wires in said third layer.

An apparatus in accordance with the present invention for producing a 37-wire unilay stranded conductor comprises first guide means for guiding a central substantially circular core wire having a central axis and a predetermined diameter D. First winding means is provided for winding a first layer of six wires having a diameter D on said core wire with a predetermined lay direction. Second winding means is provided for winding twelve wires of diameter D on said first layer with a lay substantial equal to said predetermined lay to provide a stable 19-wire "hex" unilay conductor construction that generally defines, in cross section, a hexagon that circumscribes said wires in said second layer. Wires positioned at said corners of said hexagon initially define a maximum radial dimension of 5 D and face wires positioned between said corner wires, in said second layer, define a concentric circle having a diameter of approximately 4.46 D. Forming means is provided downstream of said second winding means to form or shape the wires at the corners of the hexagon to reduce the maximum radial direction of said wires to approximately 4.7 D and form radially outwardly facing bearing surfaces. Third winding means is provided for winding a third layer of wires on said second layer in unilay construction with six wires having diameters of 0.8 D arranged to contact with said bearing surfaces and winding twelve wires having diameters D on said second layer to contact two wires in said second layer and one of said 0.8 D wires in said third layer to provide to a circular outer configuration without undesired gaps between adjacent wires in said third layer. Twisting means is provided for twisting said wires to assemble the cable; and take-up means is provided for collecting finished cable on a take-up spool.

BRIEF DESCRIPTION OF THE DRAWINGS

The aforementioned and other features of the present invention will become more apparent from the following discussion and the accompanying drawings, wherein.

DETAILED DESCRIPTION OF PREFERRED EMBODIMENT

In order to achieve desired geometries or external physical configurations, it has been known, as noted, to compress conductors as suggested, for example, in U.S. Pat. Nos. 5,133,121; 5,449,861; and 5,260,516. However, as also suggested, forming or compression of conductors is not always practical. This is particularly true in connection with, for example, copper conductors, which tend to work-harden and become less flexible when compressed. In fact, copper cables can become quite rigid when worked. Such working occurs whenever the area of a conductor is change, even if this merely results in an elongation of the conductor. Typically, the greater the amount of deformation, the greater the hardening and stiffening that results. For example, reductions in flexibility of approximately 19% have been noted in cables including 13 wires. In a 6-wire cable, it has been noted that a 2%–3% reduction of flexibility has resulted, as compared with the flexibility of such a conductor having a reverse lay construction for the same wire. However, reverse lay constructions require multiple passes or operations and likewise increase the cost of production. The problem can sometimes be overcome by annealing the wires after work-hardening. However, such annealing requires a separate operation and also adds cost to the manufacturing process.

The objective of the invention, therefore, is to provide a unilay cable which is to traditional reverse wire construction but which provides similar flexibility as that provided by stranded conductors. This is achieved by providing a conductor which exhibits the desired geometrical or physical properties while minimally adversely affecting the flexibility of the cable by minimally forming a very small proportion of the individual wires forming the cable.

Figure 5:
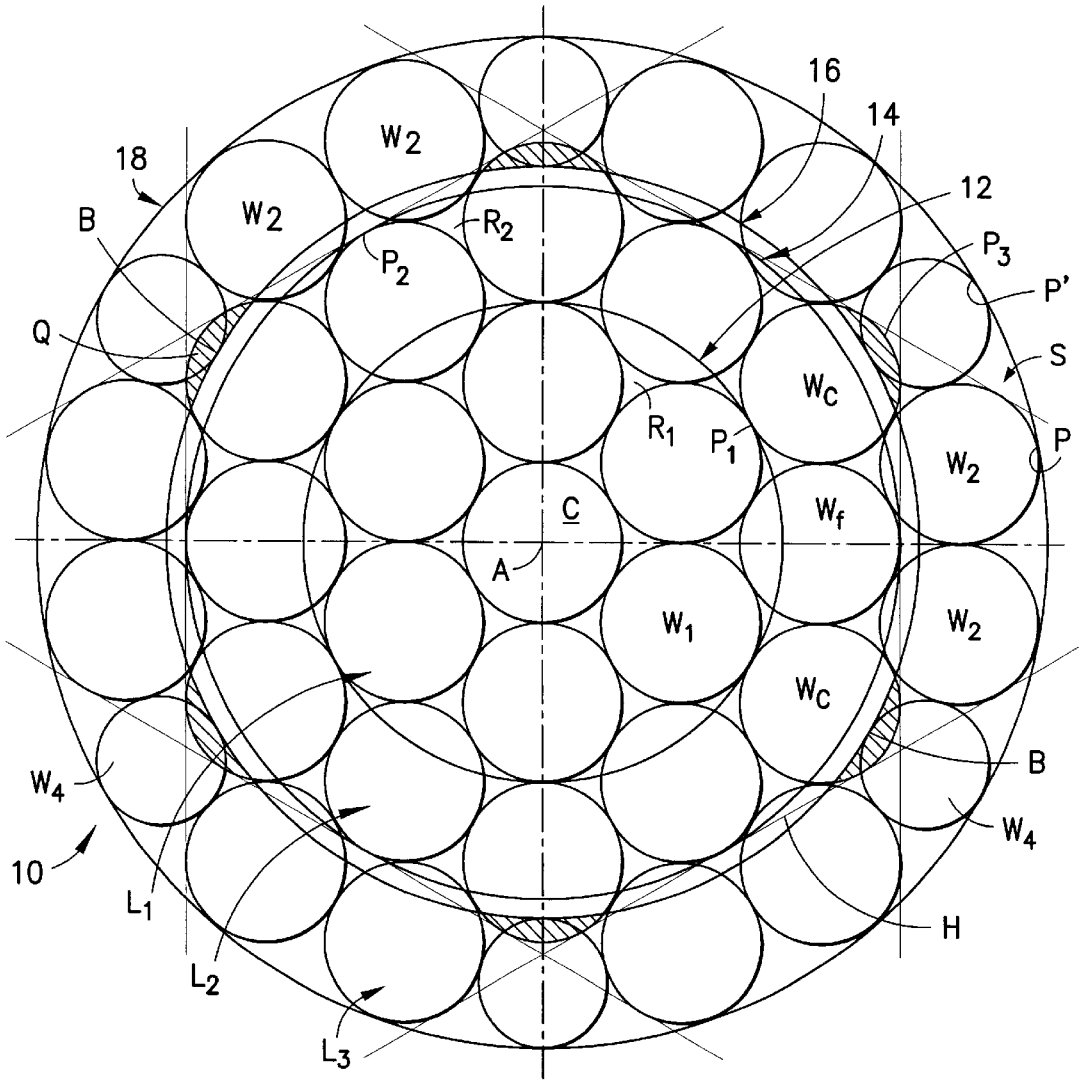
FIG. 5 is an enlarged end elevational view of a fully assembled 37-wire stranded conductor in accordance with the present invention.

Referring to FIG. 5, a combination 37-wire unilay stranded conductor is generally designated by the reference numeral 10. The conductor includes a central, substantially circular core wire C having a central axis A and a predetermined diameter D. First and second layers $L_1$ and $L_2$ consist of six and twelve wires, $W_1$ and $W_c/W_f$, respectively, each of these wires likewise having a diameter D and being stranded in unilay construction about the core wire C and arranged so that, in cross section, each of the wires $W_1$ in the first layer $L_1$ is in contact with the core wire C and with circumferentially adjacent wires in the first layer. The six wires $W_1$ in the first layer $L_1$ successively form first peaks $P_1$ circumferentially spaced from each other along a first concentric circle 12 having a diameter approximately equal to 3 D and first recesses $R_1$ between the first peaks $P_1$. The twelve wires $W_c/W_f$ in the second layer $L_2$ are successively arranged on the first peaks $P_1$ and seated within the first recesses $R_1$ to generally define a hexagon H that circumscribes the wires $W_c/W_f$ in the second layer. Wires $W_c$ at the corners of the hexagon H are arranged on the first peaks $P_1$ and intermediate face wires $W_f$ between the corner wires are arranged within the first recesses $R_1$ so that each of the corner wires $W_c$ contacts one of the wires $W_1$ in the first layer $L_1$ and two circumferentially adjacent wires in the second layer, as shown, and each face wire $W_f$ contacts two of the wires in the first layer $L_1$ and two circumferentially adjacent wires in the second layer. The face wires $W_c$ contact two of the wires $W_1$ in the first layer $L_1$ and two circumferentially adjacent wires in the second layer. The face wires in the second layer define radially outward peaks $P_2$ and are arranged on a second concentric circle 14 having a diameter approximately equal to 4.46 D. The corner wires $W_c$ in the second layer $L_1$ are each formed to provide a bearing surface B substantially arranged on a third concentric circle 16 having a diameter approximately equal to 4.7 D.

The corner and face wires $W_c$ and $W_f$ form radially outwardly facing second recesses $R_2$ therebetween.

A third layer, $L_3$ is provided which includes 12 wires $W_2$, each having a diameter D and arranged in pairs circumferentially spaced about the axis A and seated within two adjacent second recesses $R_2$ to make contact with adjacent corner and face wires $W_c$ and $W_f$ in the second layer $L_2$ and forming peaks $P_4$ substantially arranged on a fourth concentric circle 18 having a diameter approximately equal to 6.2 D and forming circumferentially spaced receiving spaces S proximate to and facing radially outwardly from each bearing surface B.

Smaller diameter wires having a diameter approximately equal to 0.8 D are positioned within and substantially filling each receiving space S to make contact with a bearing surface B on a "modified" corner wire $W_f$ and two circumferentially adjacent full diameter wires D. In this manner, all the wires in the conductor are in contact with at least one wire in a previous inner layer and with circumferentially adjacent wires in the same layer for providing a stable construction while substantially providing a circular outer configuration without undesired gaps between adjacent wires in the third layer.

While the specific shape or configuration of the bearing surfaces B is not critical, each bearing surface as shown in accordance with the invention comprises a generally convex surface substantially coextensive with said third concentric circle 16. On the basis of the geometry, with the bearing surface as described, smaller diameter wires $W_4$ substantially fill the receiving spaces S without undesired gaps and while providing a substantially perfect exterior circular configuration as the peaks $P_4$ and $P_4$ all line up on the exterior circle 18.

By way of example, when the diameter D is selected to be approximately 0.123 inches, the diameter of the first circle 12 is approximately equal to 0.37 inches, the diameter of the second circle 14 is approximately 0.55 inches, the diameter of the third circle 16 is approximately 0.578 inches and the diameter of the fourth circle 18 is approximately 0.775 inches.

Figure 1:
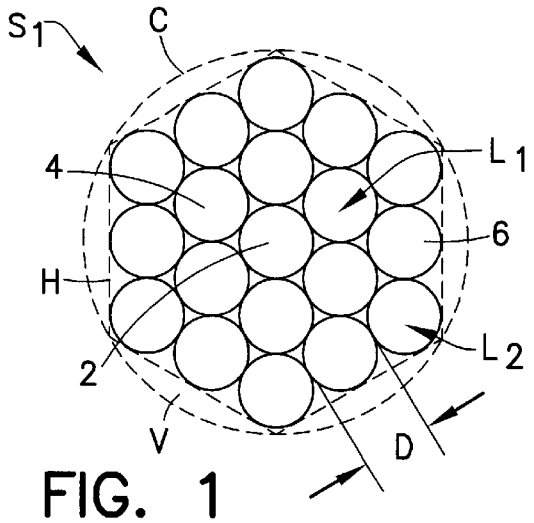
FIG. 1 PRIOR ART
FIG. 1 is a pictorial end view representation of a prior art strand consisting of 19 wires of the same diameter, including a core wire, 6 wires of an inner layer and 12 wires of an outer layer, which are twisted about the central wire, shown collapsed into a hexagonal pattern as a result of the outer wires being received within the interstitial grooves formed by the intermediate layer wires.
Figure 2:
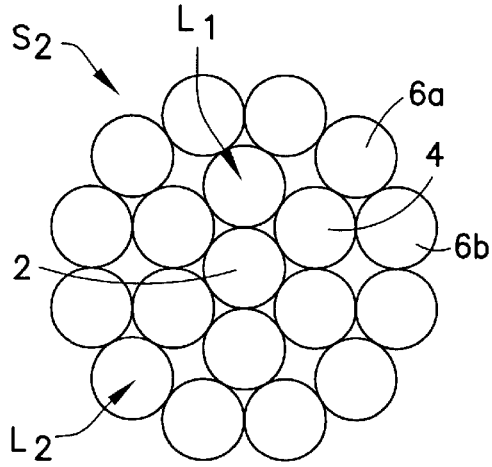
FIG. 2 PRIOR ART
FIG. 2 is similar to FIG. 1, but shows a 19 conductor strand known in the art as a "smooth body" strand, in which pairs of adjacent wires in the outermost layer are perched on the surfaces of the wires of the intermediate layers.
Figure 3:
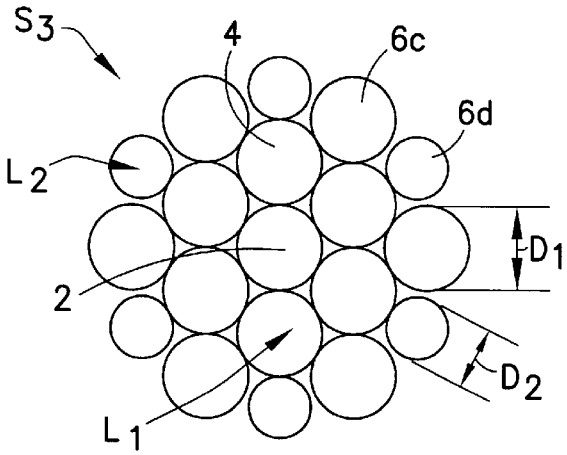
FIG. 3 PRIOR ART
FIG. 3 is similar to FIGS. 1 and 2, but showing a prior art construction of the type disclosed in U.S. Pat. No. 4,471,161, in which the outer layer is formed of some wires having the same diameter as those of the inner layers and which alternate with wires of smaller diameter, in which the large diameter wires of the outer layer are received within the interstitial grooves of the wires of the intermediate layer while the wires of a similar diameter are perched on the radially outermost crests of the intermediate wires.
Figure 4:
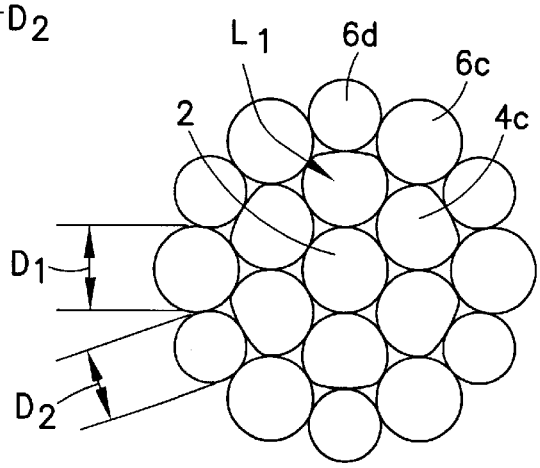
FIG. 4 PRIOR ART
FIG. 4 is similar to FIG. 3 with the exception that the central core wire and the first layer of 6 wires is compressed, through a die, to reduce the areas of the intermediate layer wires and provide substantially flat surfaces facing radially outwardly to permit the smaller diameter wires in the outer layer to enable the wires in the outer layer to be closer to each other than in the strand shown in FIG. 3.

As suggested previously in connection with FIG. 1, a 19-wire stable unilay construction, exhibiting a hexagonal outer cross section, is well known, and is a stable construction. In accordance with the present invention, such a 19-wire construction can be readily used as a starting point to manufacture the 37-wire cable. Thus, a 19-wire cable can have the corner wires $W_c$ suitably formed or shaped to provide the bearing surfaces B facing radially outwardly as shown in FIG. 5. The third layer of wires, including a smaller diameter wire $W_4$ having a diameter of approximately 0.8 D, may be placed in juxtaposed position against each bearing surface B, while a pair of two full sized diameter wires are positioned between the smaller wires and nested in a recess formed by two wires in a preceding underlying layer to define a substantially circular outer cable configuration.

Figure 6:
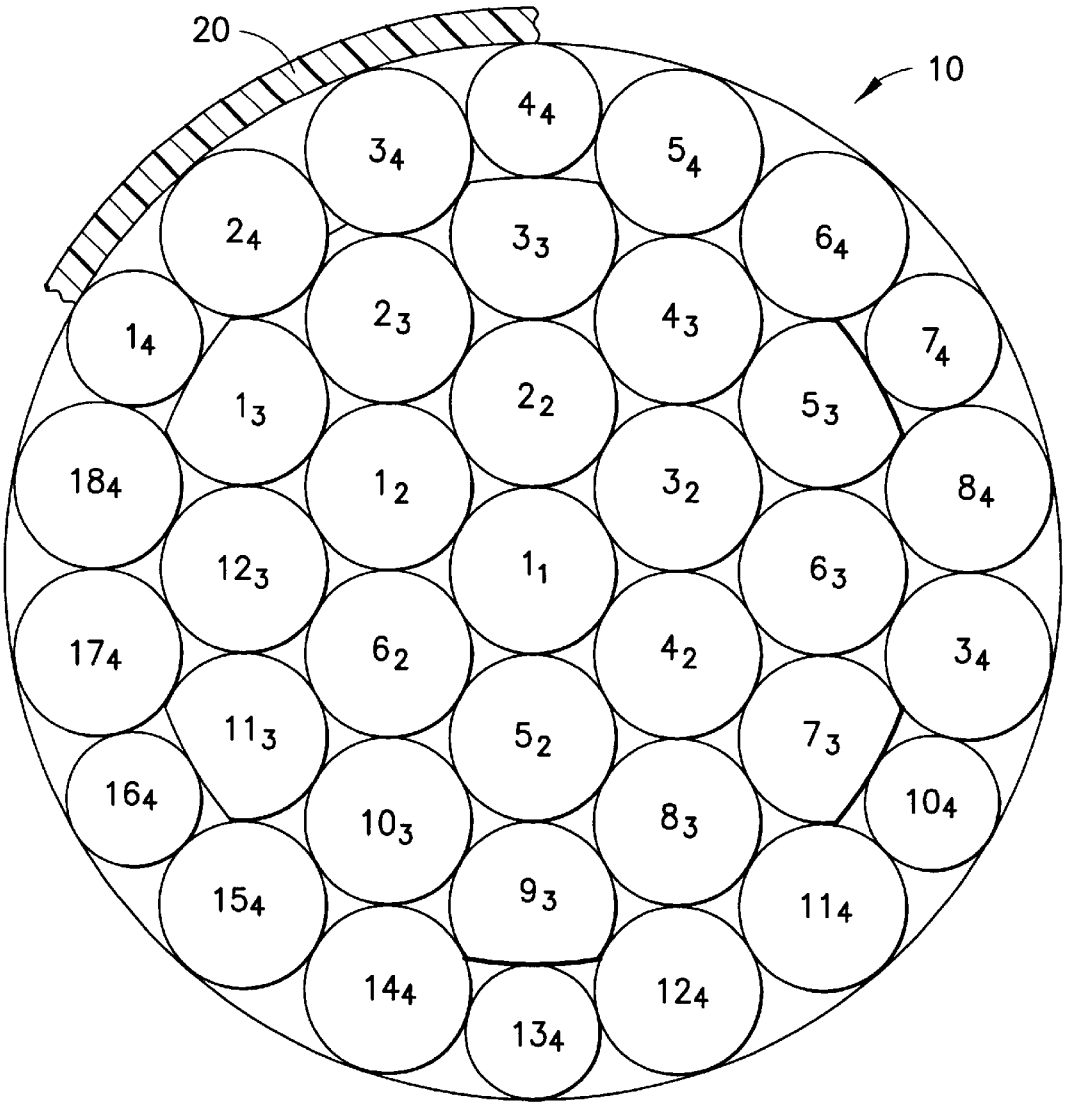
FIG. 6 is similar to FIG. 5, but also showing a section of insulation applied over the outermost layer of the conductor.

A section of cable 20 is shown in FIG. 6, which also identifies each of the wires in the composite cable. As described, therefore, all the wires in the combination or composite conductor, namely, $\mathbf{1}_1$, $\mathbf{1}_2$–$\mathbf{6}_2$, $\mathbf{1}_3$–$\mathbf{12}_3$, $\mathbf{2}_4$, $\mathbf{3}_4$, $\mathbf{5}_4$, $\mathbf{6}_4$, $\mathbf{8}_4$, $\mathbf{9}_4$, $\mathbf{11}_4$, $\mathbf{12}_4$, $\mathbf{14}_4$, $\mathbf{15}_4$, $\mathbf{17}_4$ and $\mathbf{18}_4$ are all identical wires having the same diameter D. Smaller diameter wires (0.8 D) $\mathbf{1}_4$, $\mathbf{4}_4$, $\mathbf{7}_4$, $\mathbf{10}_4$, $\mathbf{13}_4$ and $\mathbf{16}_4$ are all provided with the same diameter. Therefore, the only conductors that have been deformed or modified in any way are the corner conductors $\mathbf{1}_3$, $\mathbf{3}_3$, $\mathbf{5}_3$, $\mathbf{7}_3$, $\mathbf{9}_3$ and $\mathbf{11}_3$. It is only these last six mentioned wires that are worked by a hex die, as to be described. It will be appreciated, therefore, that the present invention provides conductors having the desired external shapes or configurations without compromising flexibility and while retaining most of the advantages of reverse lay constructions.

The method of producing a 37-wire unilay stranded conductor in accordance with the invention includes the steps of advancing a substantially circular core wire having a diameter D and a central axis along a predetermined path or direction, generally coinciding with the stranding equipment, as to be more fully discussed in connection with FIGS. 7 and 8. A first layer of six wires having a diameter D are initially wound on a core wire with a predetermined lay. A second layer of twelve wires having a diameter D is subsequently wound on the first layer, with the lay substantially equal to the lay of the first layer, to provide a stable 19-wire hex unilay conductor construction that generally defines, in cross section, a hexagon that circumscribes the wires in the second layer. As such, the wires $W_c$ positioned at the corners of the hexagon initially define a maximum radial dimension of 5 D and face wires $W_f$ positioned between the corner wires in the second layer define a concentric circle having a diameter of approximately 4.46 D. The resulting hexagonal cross sectioned conductor is now fed through, to be described, a hexagonal die which is configured and dimensioned to form or shape the corner wires to reduce the maximum diametric dimension of the corner wires to approximately 4.7 D and forming radially outwardly facing bearing surfaces B. A third layer of wires is subsequently wound on the second layer in unilay construction with six wires having diameters of 0.8 D arranged to be in contact with the bearing surfaces and winding twelve wires having diameters D on the second layer to contact two wires $W_c/W_f$ in the second layer and one of the 0.8 D wires $W_4$ in the third layer to provide a circular outer configuration without undesired gaps between adjacent wires in the third layer. Since only the corner wires $W_c$ need to be formed or shaped, the hex die needs to be aligned with the hex-shaped 19-wire construction. As will be described in connection with FIGS. 7 and 8, such alignment may be achieved by mounting the hex die on a bearing so that it can freely rotate and respond to the actual positional deviation of the multi-wire conductor. However, as to be described, the hex die may also be fixed against rotation.

As suggested, the 37-wire unilay stranded conductor of the present invention can be totally assembled from individual strands or wires, or such conductor can also be formed starting with a 19-wire unilay conventional construction, which assumes the hexagonal exterior configuration as shown in FIG. 1. However, the description of FIGS. 7 and 8 will be for a line for producing such a 37-wire conductor, starting with individual wires.

Figure 7:
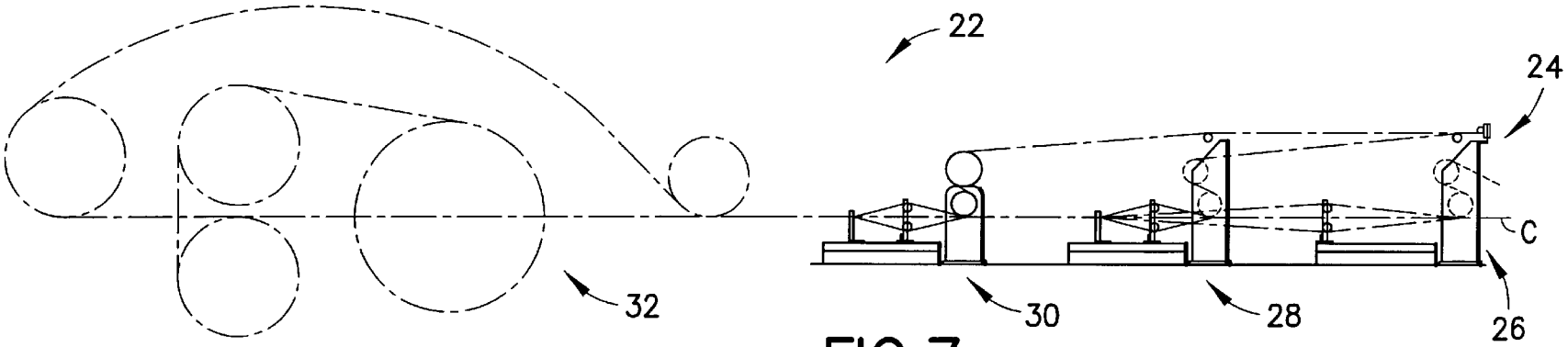
FIG. 7 is a typical line layout that may be used to produce the 37-wire conductors in accordance with the present invention, including three S-roll set-up stations and a double twisting machine.
Figure 8:
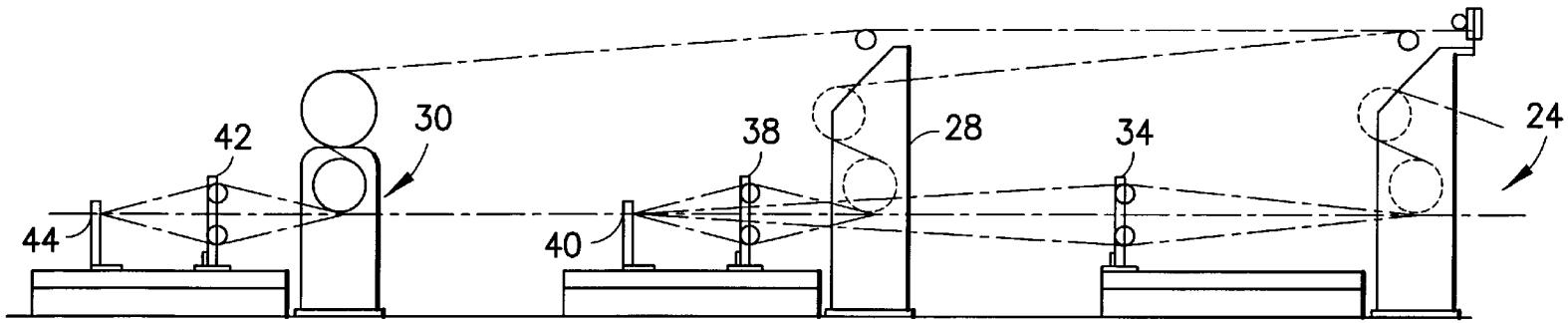
FIG. 8 is a side elevational view of the upstream end of the line shown in FIG. 7, illustrating some of the relevant details as well as the "hex" die in accordance with the invention.

Thus, the apparatus in FIG. 7 is generally designated by the reference numeral 22 and includes a pay-off station 24 (supply spools not shown) which supplies a central substantially circular core wire C having a central axis preferably aligned with the axis of the line and having the predetermined diameter D. A first winding station 26, which may be in the form of an S-roll set-up station, winds a first layer of six wires, each having a diameter D, on the core wire with a predetermine lay direction. A second winding station 28, which may be similar to the first station, is used for winding twelve wires of diameter D on the first layer with a lay substantially equal to that of the predetermined first lay to provide a stable 19-wire "hex" unilay conductor construction that generally defines, in cross section, a hexagon that circumscribes the wires in the second layer. The corner wires positioned at the corners of the hexagon initially define a maximum diametrical dimension of 5 D and the face wires positioned between the corner wires in the second layer define a concentric circle having a diameter of approximately 4.46 D.

An important feature of the present invention is the provision of forming or shaping means, downstream of the second winding station 28, to form or shape the wires at the corners of the hexagon to reduce the maximum diametric dimension of the corner wires to approximately 4.7 D and form radially outwardly facing bearing surfaces B as described. This is achieved by removing or deforming the corner wires by eliminating the hatched areas Q in FIG. 5.

A third winding station 30, which may be similar to the stations 26 and 28, is provided for winding a third layer $L_3$ of wires on the second layer $L_2$ in unilay construction with six wires $W_4$ having diameters 0.8 D arranged to contact the bearing surfaces B as described and winding twelve wires $W_2$ having diameters D on the second layer to contact two wires in the second layer and one of the 0.8 D wires in the third layer to provide a circular outer configuration without undesired gaps between adjacent wires in the third layer.

A double twist machine 32 is preferably provided downstream of the line for twisting and closing the cable together with suitable take-up means, inside or outside the double twist machine, for collecting the finished cable on a take-up spool as well known to those slatted in the art.

As suggested, the hex die 40 is arranged between the second and third winding stations 28, 30. Preferably, the apparatus further includes suitable positioning means associated with at least some of the winding stations for evenly distributing and guiding the wires. For example, positioning means is shown in FIG. 8 as a lay plate 34 and lay plates 38 and 42, which precede dies 40 and 44, respectively.

Figure 9:
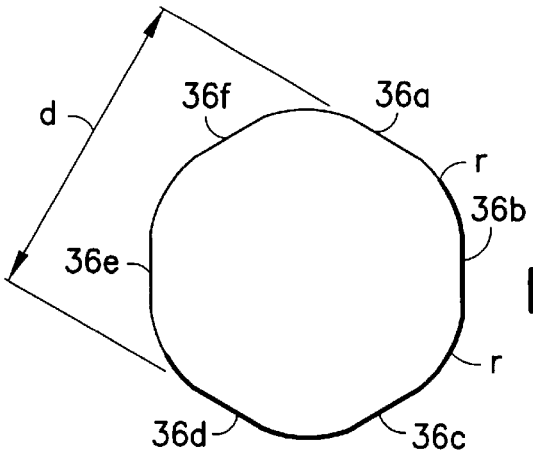
FIG. 9 is a schematic representation of the outline or shape of a hex die in accordance with the invention.

One feature of the invention is that a hex die is provided which may be rotatably mounted for generally friction-free rotation about the axis of the core wire and can adjust itself to orient its angular position to accommodate variations in the orientation of the semi-wound conductor between the second and third winding stations. For this purpose, the hex die 40 may be preferably mounted for rotation on a bearing to minimize friction on the die so that it can respond to even small fluctuations in the position of the cable. In this connection, reference is made to FIG. 9, which is an outline of the opening in the hex die 40. Thus, the hex die is formed by six generally flat surfaces **36*a*–36*f* arranged in a hexagonal configuration, with each two adjacent flat surfaces being connected by a rounded surface r, opposing flat surfaces being generally parallel to each other. By way of example only, each pair of opposing flat surfaces may be spaced a distance of approximately 4.46 D and the rounded surfaces have a radius of curvature of approximately 2.35 D. When the diameter D of the individual wires is selected to be 0.123 in., and the flat surfaces 36*a*–36*f*** are spaced a distance of approximately 0.550 in the radii of curvature are equal to approximately 0.289 in.

It should be clear that forming or shaping will only take place at the rounded surfaces r, as the remaining conductors will fall within the outline defined by the die opening. The only wires that will protrude beyond the outline (hatched areas in FIG. 5) will be the corner wires $W_c$. Once the 19-wire hexagonal "intermediate" cable is introduced into the die 40, the die will automatically rotate to that position or orientation relative to the cable which will result in the least amount of friction. This will be the position where the corner wires $W_c$ will engage the rounded surfaces r. If the cable shifts angularly, such "floating" hex die will simply follow that movement as it represents the position of least work or friction that the die must exert on the conductor. However, while the presently preferred embodiment mounts the hex die for free rotation, such die may also be locked or fixed against rotation, as the twisting generally starts at the hex die and there is minimal twist upstream of this die.

It should also be clear that the cable which has been described provides most of the advantages that previous cables have sought to achieve, including a desired exterior circular configuration, substantial elimination of gaps between conductors in the outer layer to thereby minimize the amount of insulation that is "absorbed" by the completed conductor and substantially retains all its flexibility. The method and apparatus for making the cable need very little by way of modification of procedures and equipment used in making prior art cables. Because there is no need or requirement that individual strands or wires be compressed or compacted, production can be significantly simplified and efficiency of production increased.

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What I claim:

1. A method of producing a 37-wire unilay stranded conductor, comprising the steps of advancing a substantially circular core wire having a diameter D and a central axis along a predetermined direction; winding a first layer of six wires having a diameter D on said core wire with a predetermined lay; winding a second layer of twelve wires of diameter D on said first layer with a lay substantially equal to said predetermined lay to provide a stable 19-wire "hex" unilay conductor construction that generally defines, in cross section, a hexagon that circumscribes said wires in said second layer, wherein wires positioned at said corners of said hexagon initially define a maximum diametric dimension of 5 D and face wires positioned between said corner wires in said second layer define a concentric circle having a diameter of approximately 4.46 D; feeding said "hex" conductor through a hexagonal die configured and dimensioned to form said corner wires to reduce the maximum diametric dimension of said corner wires to approximately 4.70 D and forming radially outwardly facing bearing surfaces; and winding a third layer of wires on said second layer in unilay construction with six wires having diameters 0.8 D arranged in contact with said bearing surfaces and winding twelve wires having a diameter D on said second layer to contact two wires on said second layer and one of said 0.8

D wires on said third layer to provide a circular outer configuration without undesired gaps between adjacent wires in said third layer.

2. A method of producing a 37-wire unilay stranded conductor as defined in claim 1, wherein said forming step modifies the corner conductors independently of the orientation of said hex-shaped conductor.

3. A method of producing a 37-wire unilay stranded conductor as defined in claim 1, further comprising the step sensing the orientation of said hex unilay conductor and forming said corner wires in any orientation thereof about said axis.

* * * * *